US009399998B1

(12) United States Patent
Hardie

(10) Patent No.: US 9,399,998 B1
(45) Date of Patent: Jul. 26, 2016

(54) CEILING FAN WITH AIR IONIZING FAN BLADES

(71) Applicant: Johnathan A. Hardie, Phelan, CA (US)

(72) Inventor: Johnathan A. Hardie, Phelan, CA (US)

( * ) Notice: Subject to any disclaimer, the term of this patent is extended or adjusted under 35 U.S.C. 154(b) by 431 days.

(21) Appl. No.: 14/077,531

(22) Filed: Nov. 12, 2013

(51) Int. Cl.

| | |
|---|---|
| ***F04D 25/02*** | (2006.01) |
| ***F04D 29/18*** | (2006.01) |
| ***F04D 29/70*** | (2006.01) |
| ***F04D 25/08*** | (2006.01) |
| ***F04D 29/38*** | (2006.01) |

(52) U.S. Cl.
CPC ..... *F04D 29/181* (2013.01); *F04D 25/088* (2013.01); *F04D 29/388* (2013.01); *F04D 29/703* (2013.01)

(58) Field of Classification Search
CPC ... F04D 25/088; F04D 27/006; F04D 29/181; F04D 29/388; F04D 29/70; F04D 29/703
See application file for complete search history.

(56) References Cited

U.S. PATENT DOCUMENTS

| | | | | |
|---|---|---|---|---|
| 3,422,263 | A * | 1/1969 | Jiro | A61L 9/22 250/435 |
| 4,422,824 | A | 12/1983 | Eisenhardt | |
| 4,504,191 | A * | 3/1985 | Brown | F04D 25/088 392/362 |
| D304,229 | S | 10/1989 | Rezek | |
| 5,601,636 | A * | 2/1997 | Glucksman | F24F 3/1603 55/356 |
| 5,887,785 | A | 3/1999 | Yilmaz | |
| 6,244,820 | B1 * | 6/2001 | Yilmaz | F04D 25/088 416/146 R |
| 6,790,004 | B2 * | 9/2004 | Steinheiser | F04D 29/703 416/146 R |
| 7,115,158 | B1 | 10/2006 | Landrum | |
| 7,876,560 | B2 * | 1/2011 | Huang | F04D 17/04 361/690 |
| 8,080,203 | B2 * | 12/2011 | First et al. | A61L 9/20 422/121 |
| 2003/0206801 | A1 * | 11/2003 | Lee | F04D 27/008 416/31 |
| 2004/0141848 | A1 | 7/2004 | Beaven | |
| 2007/0009363 | A1 | 1/2007 | King | |
| 2012/0257972 | A1 * | 10/2012 | Canal et al. | F03D 11/0033 416/146 R |

* cited by examiner

*Primary Examiner* — Igor Kershteyn
(74) *Attorney, Agent, or Firm* — Kyle A. Fletcher, Esq.

(57) ABSTRACT

The ceiling fan with air ionizing fan blades includes at least one air ionizing member secured to a top surface of a fan blade, and which electrostatically purifies air regardless of whether the ceiling fan is operating. The air ionizing member is integrated along a top surface as well as a leading edge of the fan blade, and shall collect particulates thereon for later removal. The air ionizing member is in wired communication with an electrical source that provides a high voltage needed for the air ionizing member to generate negative ions. The air ionizing member includes an electrostatically charged plate that produces positively or negatively charged gas ions that particulates stick to in a manner similar to static electricity. The air ionizing member may be a permanent fixture of or a removable component to the respective fan blade.

13 Claims, 4 Drawing Sheets

CEILING FAN WITH AIR IONIZING FAN BLADES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of ceiling fans, more specifically, a ceiling fan that includes fan blades that are able to ionize air passing across the surface of the fan blades.

B. Discussion of the Prior Art

As will be discussed immediately below, no prior art discloses a ceiling fan in which at least one of the ceiling fan blades is outfitted with an air ionizing member that when in use shall electrostatically attract particulates thereby purifying the air passing there across; wherein the air ionizing capability is integrated along a top surface as well as a leading edge of the fan blade, and shall collect particulates thereon for later removal; wherein the air ionizing member is in wired communication with an electrical source that provides a negative ions; wherein the air ionizing member includes an electrostatically charged plate that produces positively or negatively charged gas ions that particulates stick to in a manner similar to static electricity; wherein the air ionizing member is able to operate independent of rotational movement of the ceiling fan; wherein the air ionizing member may be a permanent fixture of or a removable component to the respective fan blade.

The King Patent Application Publication (U.S. Pub. No. 2007/0009363) discloses a ceiling fan having an air purification system that electrostatically attracts particulates.

The Beaven Patent Application Publication (U.S. Pub. No. 2004/0141848) discloses a ceiling fan cover that collects dust material through static electricity generated by the movement of the blades. However, the ceiling fan cover is not outfitted with air ionizing members to purify the air.

The Yilmaz Patent (U.S. Pat. No. 5,887,785) discloses a ceiling fan having an electrostatic particulate matter remover. However, the electrostatic particulate matter remover is not located on a top surface of a fan blade.

The Eisenhardt, Jr. Patent (U.S. Pat. No. 4,422,824) discloses a ceiling fan having germicidal lights built into the blades. However, the germicidal lights do not attract particulates as does an air ionizing member.

The Landrum Patent (U.S. Pat. No. 7,115,158) discloses a ceiling fan having blade members that include an ionizing grid for air purification. However, the ionizing grid is not positioned atop of the blade members.

While the above-described devices fulfill their respective and particular objects and requirements, they do not describe a ceiling fan in which at least one of the ceiling fan blades is outfitted with an air ionizing member that when in use shall electrostatically attract particulates thereby purifying the air passing there across; wherein the air ionizing capability is integrated along a top surface as well as a leading edge of the fan blade, and shall collect particulates thereon for later removal; wherein the air ionizing member is in wired communication with an electrical source that provides a high voltage needed for the air ionizing member to generate negative ions; wherein the air ionizing member includes an electrostatically charged plate that produces positively or negatively charged gas ions that particulates stick to in a manner similar to static electricity; wherein the air ionizing member is able to operate independent of rotational movement of the ceiling fan; wherein the air ionizing member may be a permanent fixture of or a removable component to the respective fan blade. In this regard, the ceiling fan with air ionizing fan blades departs from the conventional concepts and designs of the prior art.

SUMMARY OF THE INVENTION

The ceiling fan with air ionizing fan blades includes at least one air ionizing member secured to a top surface of a fan blade, and which electrostatically purifies air regardless of whether the ceiling fan is operating. The air ionizing member is integrated along a top surface as well as a leading edge of the fan blade, and shall collect particulates thereon for later removal. The air ionizing member is in wired communication with an electrical source that provides a high voltage needed for the air ionizing member to generate negative ions. The air ionizing member includes an electrostatically charged plate that produces positively or negatively charged gas ions that particulates stick to in a manner similar to static electricity. The air ionizing member may be a permanent fixture of or a removable component to the respective fan blade.

It is an object of the invention to provide a ceiling fan where at least one fan blade is outfitted with an air ionizing member along a top surface, which is able to attract and collect particulates from air thereby purifying said air, and regardless of whether the ceiling fan is operational.

A further object of the invention to provide an air ionizing member that includes a series of channels along an ionizing plate, which enable particulates to collect thereon.

A further object of the invention is to provide an air ionizing member that is either temporarily affixed atop of the ceiling fan blade or is permanently affixed thereon.

Another object of the invention is to include a stop at a distal end of each channel of the air ionizing member such that particulates air collected at the stop as opposed to being accelerated tangentially from the ceiling fan blade due to rotational movement of the ceiling fan blade.

These together with additional objects, features and advantages of the ceiling fan with air ionizing fan blades will be readily apparent to those of ordinary skill in the art upon reading the following detailed description of presently preferred, but nonetheless illustrative, embodiments of the ceiling fan with air ionizing fan blades when taken in conjunction with the accompanying drawings.

In this respect, before explaining the current embodiments of the ceiling fan with air ionizing fan blades in detail, it is to be understood that the ceiling fan with air ionizing fan blades is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ceiling fan with air ionizing fan blades.

It is therefore important that the claims be regarded as including such equivalent construction insofar as they do not depart from the spirit and scope of the ceiling fan with air ionizing fan blades. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
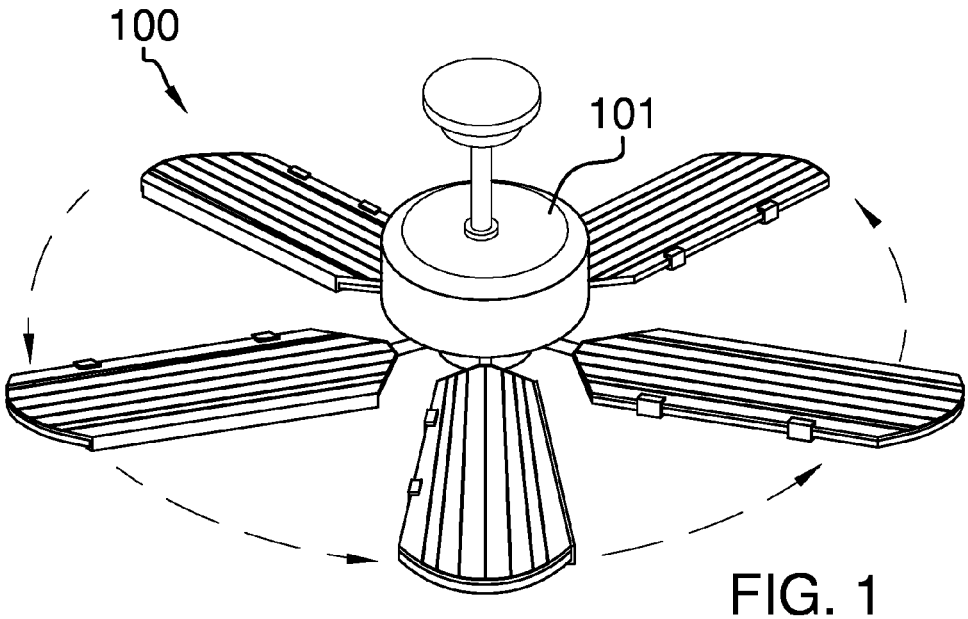
FIG. 1 illustrates a top, perspective view of the ceiling fan with air ionizing fan blades.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. A ceiling fan with air ionizing fan blades 100 (hereinafter invention) includes a ceiling fan 101 with a plurality of ceiling fan blades 102, which are each further defined with a leading edge 103 and a top surface 104.

The invention 100 improves upon ceiling fans 101 by introducing air ionizing members 200 onto the top surface 104 and along the leading edge 103 of at least of the ceiling fan blades 102. The air ionizing members 200 are ionizing plates that connect via a wire 201 to an electrical source generating high electrical voltage needed in order for the air ionizing members 200 generate positive or negative ions that attract particulates 300 thereon. The air ionizing member 200 includes a series of channels 210 that span along a length 211. The channels 210 enable the particulates 300 to collect. The air ionizing member 200 includes a stop 220 that spans across a distal end 221 of the air ionizing member 200 such that the particulates 300 collected in the channels 210 do not simply slide off of the air-ionizing member 200, which may be rotating via the ceiling fan 101.

Figure 2:
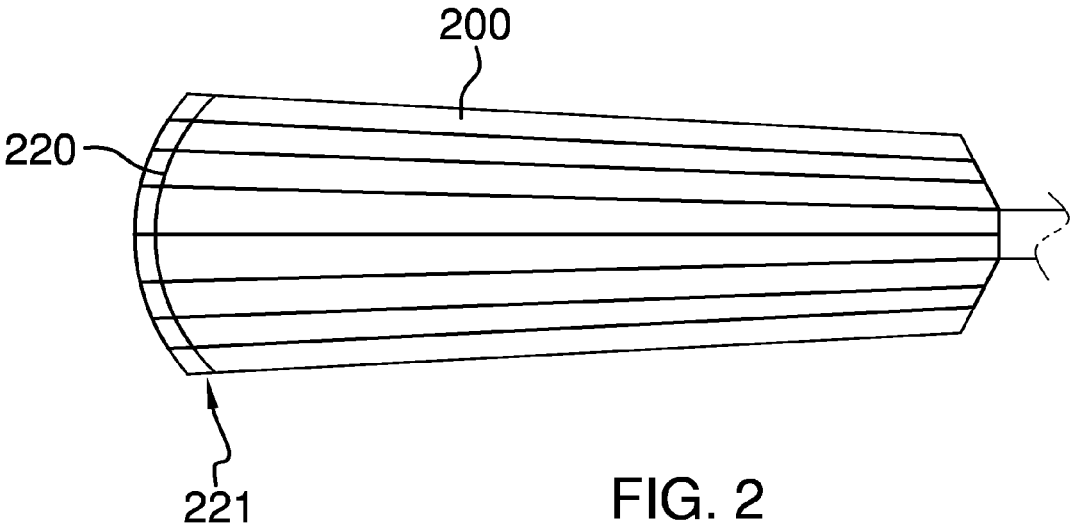
FIG. 2 illustrates a top view of one of the fan blades with the air ionizing member thereon.
Figure 3:
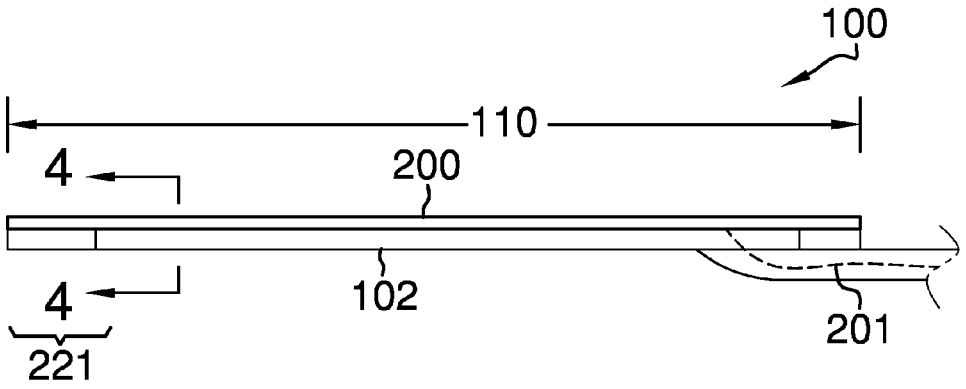
FIG. 3 illustrates a side view of the fan blade with the air ionizing member thereon.
Figure 4:
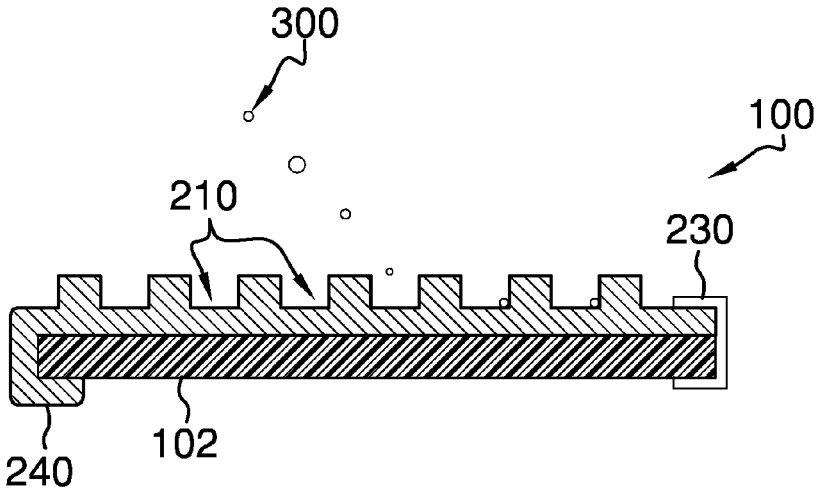
FIG. 4 illustrates a cross-sectional view along line 4-4 in FIG. 3, and depicting the contour of the air ionizing member.
Figure 6:
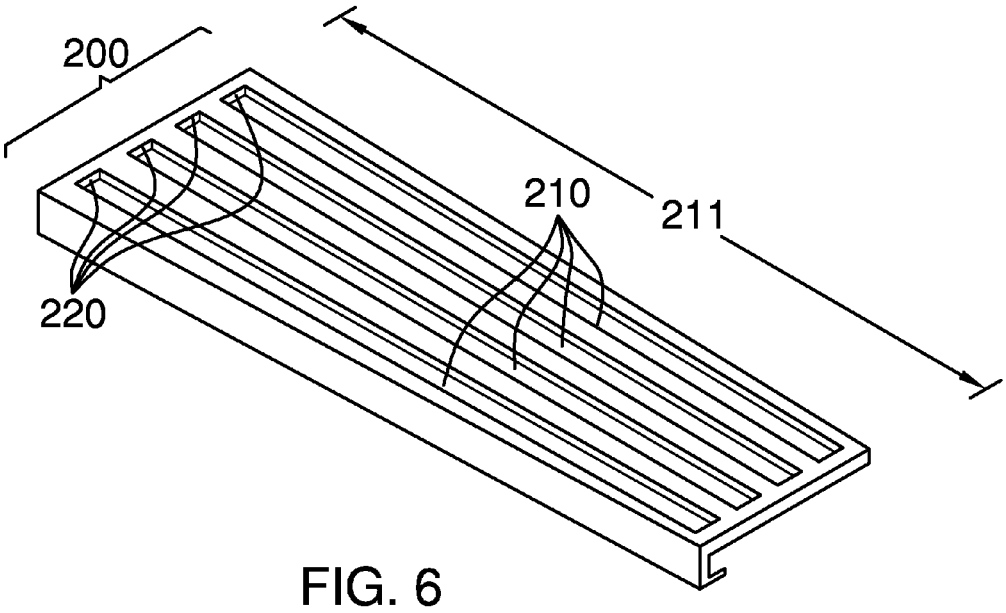
FIG. 6 illustrates a perspective view of the air ionizing member by itself.

Referring to FIGS. 2 and 6, the stop 220 may be linear or curved, and is dependent upon both the shape of the fan blade 102 as well as the air ionizing member 200. Moreover, the length 211 of the air ionizing member 200 may be equal to or less than a ceiling fan blade length 110 (see FIG. 3). Referring to FIG. 4, the air ionizing member 200 may include a leading member 240 that is designed to contour over the leading edge 103 of the ceiling fan blade 102. Moreover, the leading member 240 helps in securing the air ionizing member 200 onto the ceiling fan blade 102.

Figure 5:
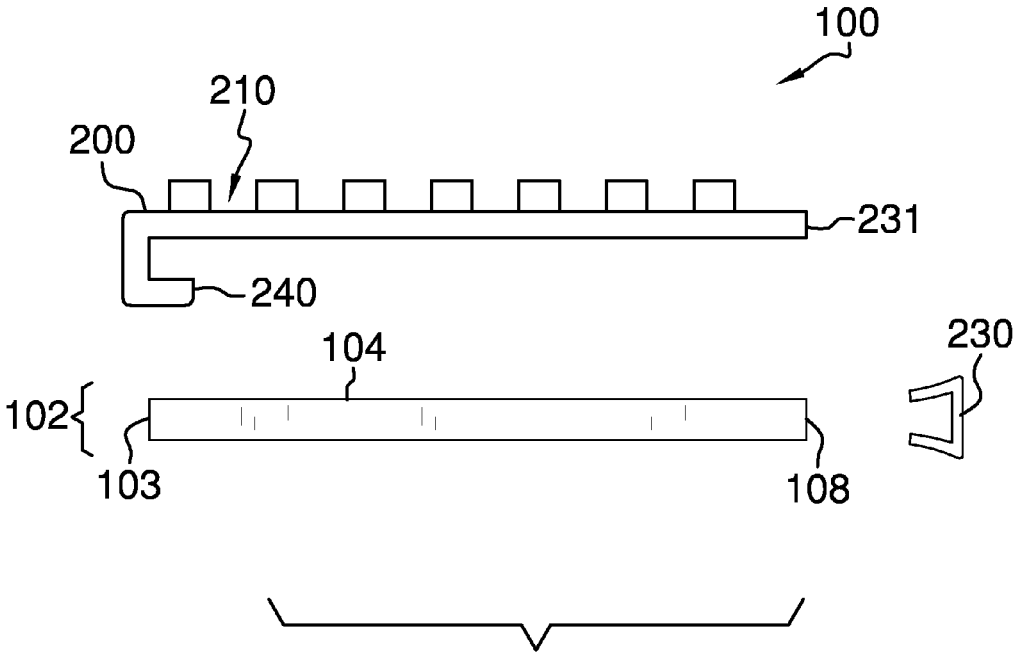
FIG. 5 illustrates an exploded view of the air ionizing member with respect to the ceiling fan blade.
Figure 7:
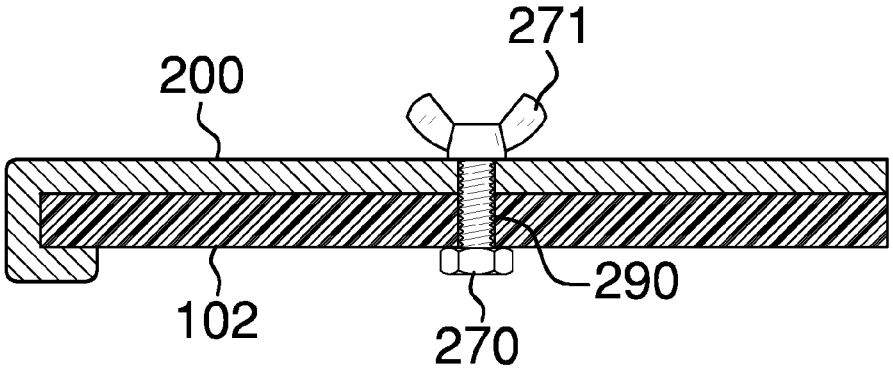
FIG. 7 illustrates another cross-sectional view of the air ionizing member bolted to the ceiling fan blade.

The air ionizing member 200 may be permanently affixed or temporarily secured to the ceiling fan blade 102. Referring to FIGS. 4-5, the air ionizing member 200 may include at least one clip 230 that clips the air ionizing member 200 onto the ceiling fan blade 102. Moreover, the clip 230 engages a tail edge 108 of the ceiling fan blade 102 as well as an ionizing tail edge 231 of the air ionizing member 200. Referring to FIG. 7, the air ionizing member 200 may be permanently affixed to the ceiling fan blade 102 via a bolt 270 and nut 271. The bolt 270 passes across a hole 290 spanning both the ceiling fan blade 102 and the air ionizing member 200. The hole 290 involves alignment of the air ionizing member 200 and the ceiling fan blade 102.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ceiling fan with air ionizing fan blades comprising:

a ceiling fan with a plurality of ceiling fan blades;

wherein at least one of the ceiling fan blades includes an air ionizing member that is secured to a top surface of the ceiling fan blade, and which is configured to attract particulates thereon, and in order to purify air regardless of operation of the ceiling fan;

wherein the ceiling fan blades are further defined with a leading edge and a tail edge;

wherein the air ionizing member attaches to the ceiling fan blade along both the top surface and the leading edge;

wherein the air ionizing member consists of an ionizing plate that connects via a wire to an electrical source generating high electrical voltage needed in order for the air ionizing member to generate positive or negative ions that attract said particulates thereon.

2. The ceiling fan with air ionizing fan blades as described in claim 1 wherein the air ionizing member includes a series of channels that span along a length; wherein the channels enable the particulates to collect therein.

3. The ceiling fan with air ionizing fan blades as described in claim 2 wherein the air ionizing member includes a stop that spans across a distal end of the air ionizing member such that the particulates collected in the channels do not slide off of the air-ionizing member in the event the ceiling fan blade is rotating via the ceiling fan.

4. The ceiling fan with air ionizing fan blades as described in claim 3 wherein the stop is contoured to the distal end of the ceiling fan blade; wherein the length of the air ionizing member is equal to or less than a ceiling fan blade length.

5. The ceiling fan with air ionizing fan blades as described in claim 4 wherein the air ionizing member includes a leading member that is designed to contour over the leading edge of the ceiling fan blade, and which aids in securing the air ionizing member onto the top surface of the ceiling fan blade.

6. The ceiling fan with air ionizing fan blades as described in claim 5 wherein the air ionizing member includes at least one clip that clips the air ionizing member onto the ceiling fan blade; wherein the clip engages a tail edge of the ceiling fan blade as well as an ionizing tail edge of the air ionizing member.

7. The ceiling fan with air ionizing fan blades as described in claim 5 wherein the air ionizing member is permanently affixed to the ceiling fan blade via a bolt and nut; wherein the bolt is inserted through a hole that passes across both the ceiling fan blade and the air ionizing member.

8. A ceiling fan with air ionizing fan blades comprising:

a ceiling fan with a plurality of ceiling fan blades;

wherein at least one of the ceiling fan blades includes an air ionizing member that is secured to a top surface of the ceiling fan blade, and which is configured to attract particulates thereon, and in order to purify air regardless of operation of the ceiling fan;

wherein the ceiling fan blades are further defined with a leading edge and a tail edge;

wherein the air ionizing member attaches to the ceiling fan blade along both the top surface and the leading edge;

wherein the air ionizing member consists of an ionizing plate that connects via a wire to an electrical source generating high electrical voltage needed in order for the air ionizing member to generate positive or negative ions that attract said particulates thereon;

wherein the air ionizing member includes a series of channels that span along a length; wherein the channels enable the particulates to collect therein.

9. The ceiling fan with air ionizing fan blades as described in claim 8 wherein the air ionizing member includes a stop that spans across a distal end of the air ionizing member such that the particulates collected in the channels do not slide off of the air-ionizing member in the event the ceiling fan blade is rotating via the ceiling fan.

10. The ceiling fan with air ionizing fan blades as described in claim 9 wherein the stop is contoured to the distal end of the ceiling fan blade; wherein the length of the air ionizing member is equal to or less than a ceiling fan blade length.

11. The ceiling fan with air ionizing fan blades as described in claim 10 wherein the air ionizing member includes a leading member that is designed to contour over the leading edge of the ceiling fan blade, and which aids in securing the air ionizing member onto the top surface of the ceiling fan blade.

12. The ceiling fan with air ionizing fan blades as described in claim 11 wherein the air ionizing member includes at least one clip that clips the air ionizing member onto the ceiling fan blade; wherein the clip engages a tail edge of the ceiling fan blade as well as an ionizing tail edge of the air ionizing member.

13. The ceiling fan with air ionizing fan blades as described in claim 11 wherein the air ionizing member is permanently affixed to the ceiling fan blade via a bolt and nut; wherein the bolt is inserted through a hole that passes across both the ceiling fan blade and the air ionizing member.

* * * * *